United States Patent [19]

Lewis

[11] Patent Number: 4,592,922

[45] Date of Patent: Jun. 3, 1986

[54] PLASMA SPRAY SCREEN REPAIR METHOD

[75] Inventor: Wallace J. Lewis, St. Louis County, Mo.

[73] Assignee: The United States of America as represented by the Secretary of the Air Force, Washington, D.C.

[21] Appl. No.: 711,936

[22] Filed: Mar. 15, 1985

[51] Int. Cl.[4] ..... B05D 1/08

[52] U.S. Cl. ..... 427/34; 427/142; 427/247; 427/423

[58] Field of Search ..... 427/34, 140, 243, 142, 427/423, 247, 10; 430/308

[56] References Cited

U.S. PATENT DOCUMENTS

| | | | |
|---|---|---|---|
| 2,592,789 | 4/1952 | Brennan | 430/308 |
| 2,924,536 | 2/1960 | Collins | 427/247 |
| 3,378,391 | 4/1968 | Winzeler et al. | 117/93.1 |
| 3,573,090 | 3/1971 | Peterson | 117/93.1 |
| 3,711,310 | 1/1973 | Leeper, Jr. | 117/2 |
| 3,936,295 | 2/1976 | Cromwell et al. | 75/0.5 R |
| 4,320,251 | 3/1982 | Narasimhan et al. | 136/256 |

*Primary Examiner*—John H. Newsome

*Attorney, Agent, or Firm*—Donald J. Singer; Jacob N. Erlich

[57] ABSTRACT

A method in high temperature repair of damaged fuel cell screens comprising the steps of forming a mask, bathing the screen to be repaired in pure argon, masking the damage site with the mask, applying to the site selected repair material via plasma spray in several cycles each cycle interspersed with a cooling period, where a test wafer may be exposed on the surface of the mask for metering purposes.

1 Claim, 2 Drawing Figures

PLASMA SPRAY SCREEN REPAIR METHOD

STATEMENT OF GOVERNMENT INTEREST

The invention described herein may be manufactured and used by or for the Government for governmental purposes without the payment of any royalty thereon.

BACKGROUND OF THE INVENTION

The present invention relates to repair of screens used in high temperature applications, and more particularly, to a method for repair of stainless steel screens used in gas pressurized fuel systems.

The principal on which all spacecraft surface tension acquisition fuel systems are based is that a wetted screen surface offers negligible resistance to fluid flow but resists gas flow up to a defined pressure difference known as bubble point. Bubble point is a function of screen opening size and in some applications bubble points equivalent to pressures of 18 inch of water are required. If this bubble point or pressure is reduced due to small damages areas or defects, these areas have to be repaired to prevent excessive pressurant gas flow and resultant entrained gas bubbles in the spacecraft fuel and reduction in performance. Excess screen surface area is normally available so that blockage of small areas with repairs will not affect the propellant flow requirements.

In the Peacekeeper Missile, stainless steel screens are used in the fuel surface tension acquisition system. These screens are fabricated from fine low carbon stainless steel wires, such as 304L. They are woven to a fine mesh, either 200×1400 mesh, having warp and shute diameters of 0.0028 and 0.0016 inches, respectively, or 325×2300 mesh, having warp and shute diameters of 0.001 and 0.0015 inches, respectively.

Repair of these fine meshes can be difficult. If the fuel tank system is not exposed to elevated temperatures either in the manufacturing cycle or in service, then repairs such as teflon or soldering can be used. But these materials have a use temperature of about 800° F. For components exposed to temperatures greater than 800° F. either in the manufacturing cycle or in operation these materials are not satisfactory. The Peacekeeper tanks are exposed to 1000° F. in the manufacturing cycle.

Plasma spray guns are available which utilize an electric arc contained within a water-cooled jacket. An inert gas, such as argon, is passed through the arc and is excited to temperatures of up to 30,000° F. The plasma of ionized gas issuing from the torch resembles an open oxyacetylene flame in shape and appearance. In use, a powdered material is controlledly fed into the plasma in the gun and is carried thereby to the base material to be coated. There are two major problems with application of this process to the repair of small holes in the above-said finely meshed screens. First, the heat generated by the plasma flame can easily destroy such screen material. Second, the plasma flame spreads out as it issues forth from the gun nozzle. Hence, pin point repair using such device is made difficult.

It is, therefore, an object of the present invention to provide a method for high temperature repair of finely meshed stainless steel screens which can withstand temperatures on the order of 1000° F.

It is another object of the present invention to provide a method for precision repair of finely meshed stainless steel screen employing a plasma spray process.

SUMMARY OF THE INVENTION

The present method comprises the steps of forming a mask, flowing argon over the screen to be repaired in pure argon, masking the damage site with the mask, applying to the site selected repair material via plasma spray in several cycles each cycle interspersed with a cooling period. In a preferred embodiment, a test wafer is exposed on the surface of the mask for metering purposes.

BRIEF DESCRIPTION OF THE DRAWINGS

The invention will be more clearly understood by reference to the following detailed description of a preferred embodiment thereof in conjunction with the accompanying drawings, in which.

DETAILED DESCRIPTION OF THE DRAWINGS

Figure 1:
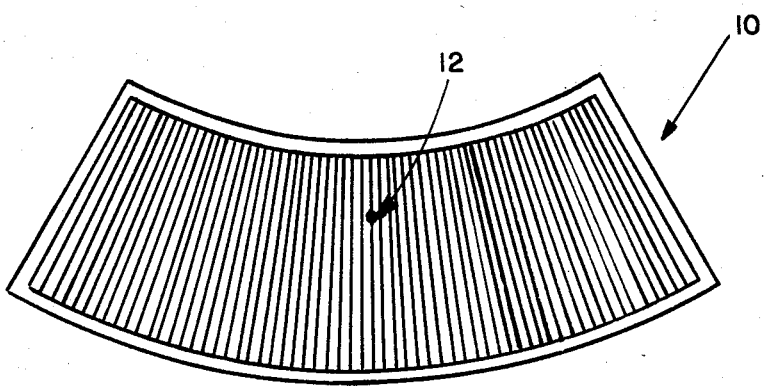
FIG. 1 is a top view of a segment of a typical fuel cell screen, having a damage site.
Figure 2:
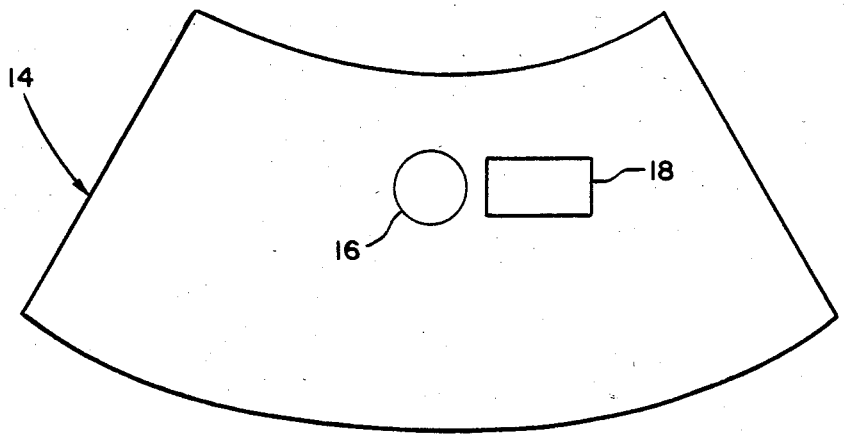
FIG. 2 is a perspective view of a mask and test wafer in practice of the present invention.

Referring to the FIG. 1, a portion of finely meshed screen 10 is shown having damaged area 12. A mask 14, having opening 16 defined therein, is created so as to be able to mask the screen from the plasma spray but for the open area 16. The opening 16 is configured to expose the screen hole damage area 12 to the plasma spray, and also to expose the screen material present at the damage site. Hence, application of the plasma spray will coat the exposed screen and will close the exposed hole as desired.

This masking provides "pin-point" accuracy, however, the plasma flame must be continually interrupted so as not to overheat the screen, and at the same time oxidation of the flame-sprayed material is to be prevented.

Hence, during application of the above mask, the screen is bathed in a pure argon gas to prevent oxidation. Also, a series of single spray cycles each interspersed with a cooling period, are performed. A single spray cycle comprises a left and right spray pass made over the repair site. After a suitable cooling period is allowed to transpire, such that the screen has returned to room temperature, a second left/right pass is made with the plasma sprayer. This process continues until the desired coating thickness is achieved.

In application of this method to repair of damaged screens to a given (such as 10 mil) thickness, a further refinement is disclosed. Hence, a test wafer 18 is placed on top of mask 14. This wafer is preferably comprised of a stainless steel material and has a thickness of a determined amount, such as 10 mils.

After several passes of the plasma spray, the layering which is building at the hole site will be represented by the sprayed material accummulated on the exposed wafter 18 as a result of the characteristic fan-out of the flame. Hence, the wafer may be removed and measured with a micrometer to determine application thickness. The number of passes may thus be limited according to the determination made by such micrometer measurement. For example, after several plasma spray cycles, a micrometer measurement may be taken. The results thereof can yield the accummulation amount per cycle. Division by two yields the accummulation amount per pass. Hence, the accummulation may be brought up to the target thickness by supplemental making of one or several left, right or left-right passes as required.

While the present invention is not limited to application of any particular material, the following information is provided. To wit: the following powder material and stainless steel screen material was used in practice of a preferred embodiment of the present invention.

| PLASMA SPRAYED POWDER | |
|---|---|
| Cobalt | 1% max |
| Carbon | 0.5% max |
| Silicon | 3–5% range |
| Chromium | 6–8% range |
| Nickel | 78–86% range |
| Iron | 2–4% range |
| Boron | 2.5–3.5% range |
| STAINLESS STEEL WIRE | |
| Carbon | 0.03% max |
| Manganese | 2% max |
| Phosphorus | 0.045% max |
| Sulfur | 0.03% max |
| Silicon | 1% max |
| Chromium | 18–20% range |
| Nickel | 8–12% range |
| Iron | remainder to 100% |

While the present invention has been described in connection with rather specific embodiments thereof, it will be understood that many modifications and variations will be readily apparent to those of ordinary skill in the art and that this application is intended to cover any adaptation or variation thereof. Therefore, it is manifestly intended that this invention be only limited by the claims and the equivalents thereof.

What is claimed is:

1. A high temperature method of repairing a small damage site in a fine mesh fuel cell screen using plasma spray, comprising the steps of:

bathing said screen in a pure argon gas atmosphere;

placing a mask into said screen, said mask having an opening therein slightly larger than the size of said damage site and overlapping said damage site with said opening in said mask;

applying a test wafer to said mask adjacent said opening in said mask, said test wafer being of a predetermined thickness;

applying to said damage site through said opening in said mask selected repair material in powder form via said plasma spray by means of a plurality of spray cycles, each cycle having at least a single spray pass over said damage site and over said test wafer on said mask, where each cycle is followed by a cooling period and where the number of passes employed is determined by the amount of accumulation of said repair material at said damage site, and determining said amount of accumulated repair material on said damage site by removing said test wafer from said mask, measuring the total thickness of said test wafer and said repair material, and subtracting said predetermined thickness of said test wafer from said total thickness.

* * * * *